US006581302B1

(12) United States Patent
Philipp et al.

(10) Patent No.: US 6,581,302 B1
(45) Date of Patent: Jun. 24, 2003

(54) DRYER FOR GOODS IN STRIP OR PANEL FORM

(76) Inventors: Rudi Philipp, Berberitzenweg 14, D-36251 Bad Hersfeld (DE); Burkhard Behrendt, Rosengartenstrasse 1A, D-36251 Bad Hersfeld (DE)

( * ) Notice: Subject to any disclaimer, the term of this patent is extended or adjusted under 35 U.S.C. 154(b) by 0 days.

(21) Appl. No.: 09/913,918

(22) PCT Filed: Mar. 10, 2000

(86) PCT No.: PCT/EP00/02139

§ 371 (c)(1),
(2), (4) Date: Aug. 17, 2001

(87) PCT Pub. No.: WO00/70283

PCT Pub. Date: Nov. 23, 2000

(30) Foreign Application Priority Data

May 12, 1999 (DE) ..... 199 22 165

(51) Int. Cl.[7] ..... F26B 13/06

(52) U.S. Cl. ..... 34/633; 34/216; 34/224; 34/231; 34/638; 34/636

(58) Field of Search ..... 34/216, 219, 231, 34/236, 224, 461, 463, 464, 487, 501, 620, 633, 638, 636, 643; 165/101

(56) References Cited

U.S. PATENT DOCUMENTS

| | | | | | |
|---|---|---|---|---|---|
| 3,296,713 | A | * | 1/1967 | Larsen et al. | 34/205 |
| 3,529,357 | A | * | 9/1970 | Schuette et al. | 34/446 |
| 4,050,885 | A | * | 9/1977 | Nowick et al. | 432/31 |
| 4,494,315 | A | * | 1/1985 | Roos et al. | 34/554 |
| 4,523,391 | A | | 6/1985 | Smith et al. | 34/225 |
| 4,777,604 | A | * | 10/1988 | Robinson | 700/208 |
| 4,831,747 | A | * | 5/1989 | Roos et al. | 34/565 |
| 5,603,168 | A | * | 2/1997 | McMahon, Jr. | 34/471 |
| 5,970,626 | A | | 10/1999 | Scmidt et al. | 34/631 |
| 6,108,931 | A | | 8/2000 | Schmidt et al. | 34/216 |

FOREIGN PATENT DOCUMENTS

| | | |
|---|---|---|
| DE | 28 1650 | 3/1913 |
| DE | 197 01 426 | 7/1997 |
| EP | 0 854 338 | 7/1998 |
| FR | 1 321 839 | 2/1963 |
| WO | WO 84/01424 | 4/1984 |

* cited by examiner

*Primary Examiner*—Ira S. Lazarus
*Assistant Examiner*—Kathryn S. O'Malley
(74) *Attorney, Agent, or Firm*—Herbert Dubno; Andrew Wilford

(57) ABSTRACT

In known rack dryers, the drying effect is weaker in the outer area on the side of the air intake into the pipe chambers than in the other areas. Said weaker drying effect is caused by turbulence in this area, which leads to a drop in the static pressure. The aim of the invention is to provide a dryer which ensures even drying of the goods across the entire width, even in the problem areas. The rack dryer is equipped with conductive bodies (20, 26) which are located on the partition wall (5) and which streamline the current in the area of the air intake into the pipe chambers in such a way, that a predominantly even static pressure prevails throughout the entire pipe chamber. The invention can be used for drying sandwich-type plaster board or wood veneer.

10 Claims, 3 Drawing Sheets

DRYER FOR GOODS IN STRIP OR PANEL FORM

DESCRIPTION

The invention relates to a dryer for strip- or plate-shaped material, in particular a multilevel dryer for gypsum board or plywood.

WO 84/01424 describes an apparatus for heating or cooling foodstuffs wherein an outer housing holds a blower, nozzle boxes, and a conveyor belt. The blower is so closely juxtaposed upstream of the nozzle that its rotation axis is generally central between the nozzle boxes. The feed chamber between the blower and the intake of the nozzle box is defined by an inner housing. Between the upper and lower nozzle boxes is a hip-roof-shaped guide body. The guide body has engaging well into the feed chamber so that the spacing of this edge from the blower only amounts to about one fourth of the width of the feed chamber. Such a guide body is not suitable for the dryer according to the invention.

Kroll describes in *Trockner und Trocknungsverfahren* (Springer; 1959; p.75ff) a dryer having a distributor wall with semicircular air-guide bodies that are arranged on the air-entry side of the chambers of a drying chamber. The distributor wall restricts the flow cross section to the chambers, thereby increasing the pressure in the chamber, and leads to a uniform air distribution to the individual chambers. Uniform flow in the individual chambers is not the goal. A chamber dryer is not analogous to this art.

The invention is based on the dryer known from German 197 01 426 where an attempt is made to create uniform drying over the entire material width. This is achieved largely in that the spacing of the nozzles from the surface of the material is adjustable at least at one end of the nozzle box and is different at both ends. It has been shown that drying near the air inlet is less in the nozzle box than over the remaining length of the nozzle box. Tests have shown that in the region immediately downstream of the air inlet in the nozzle box there is turbulence. This is the result of the compact construction of the dryer that allows a relatively high vertically oriented flow speed in the feed chamber upstream of the nozzle boxes. Thus the speed in the air-entry region in the nozzle boxes has, in addition to the horizontal, also a vertical component that creates the turbulence. This means in practice that overall the drying time is increased in order to ensure the maximal permissible residual moisture over the entire material. Thus more energy must be used for drying than would be necessary under optimal circumstances.

It is an object of the invention to provide a dryer with the features of the characterizing clause wherein more uniform drying with better energy use is achieved on the intake side of the nozzle box.

By the use of the invention there is a uniformly directed flow without significant turbulence even in the intake region of the nozzle box. In the nozzle boxes the pressure relationships are largely stable so that the drying air can exit uniformly from all nozzles.

Preferred embodiments of the invention are given.

The drawing serves for describing the invention with reference to simplified illustrated embodiments.

Figure 1:
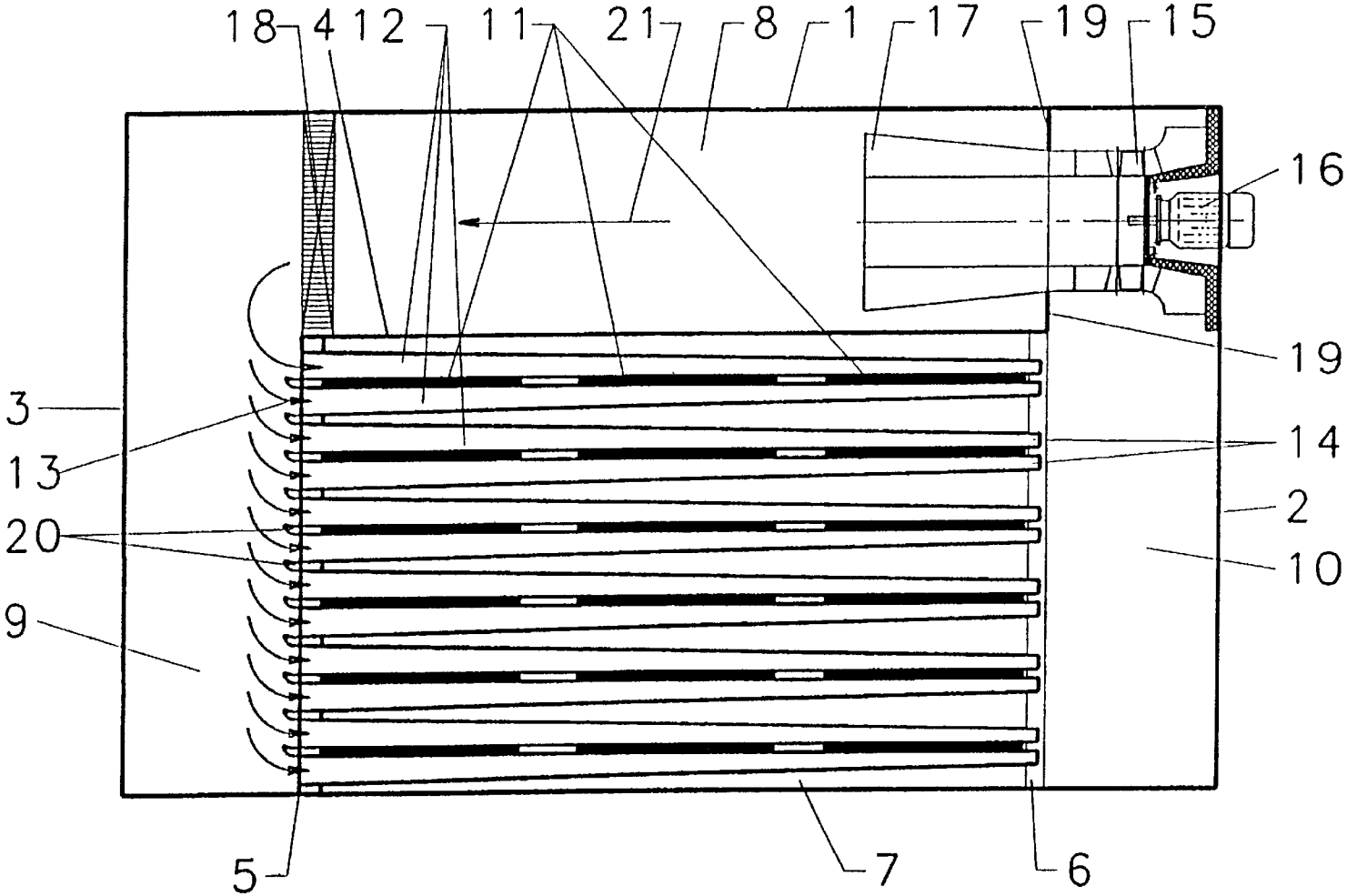
FIG. 1 shows a cross section through a dryer according to the invention.
Figure 2:
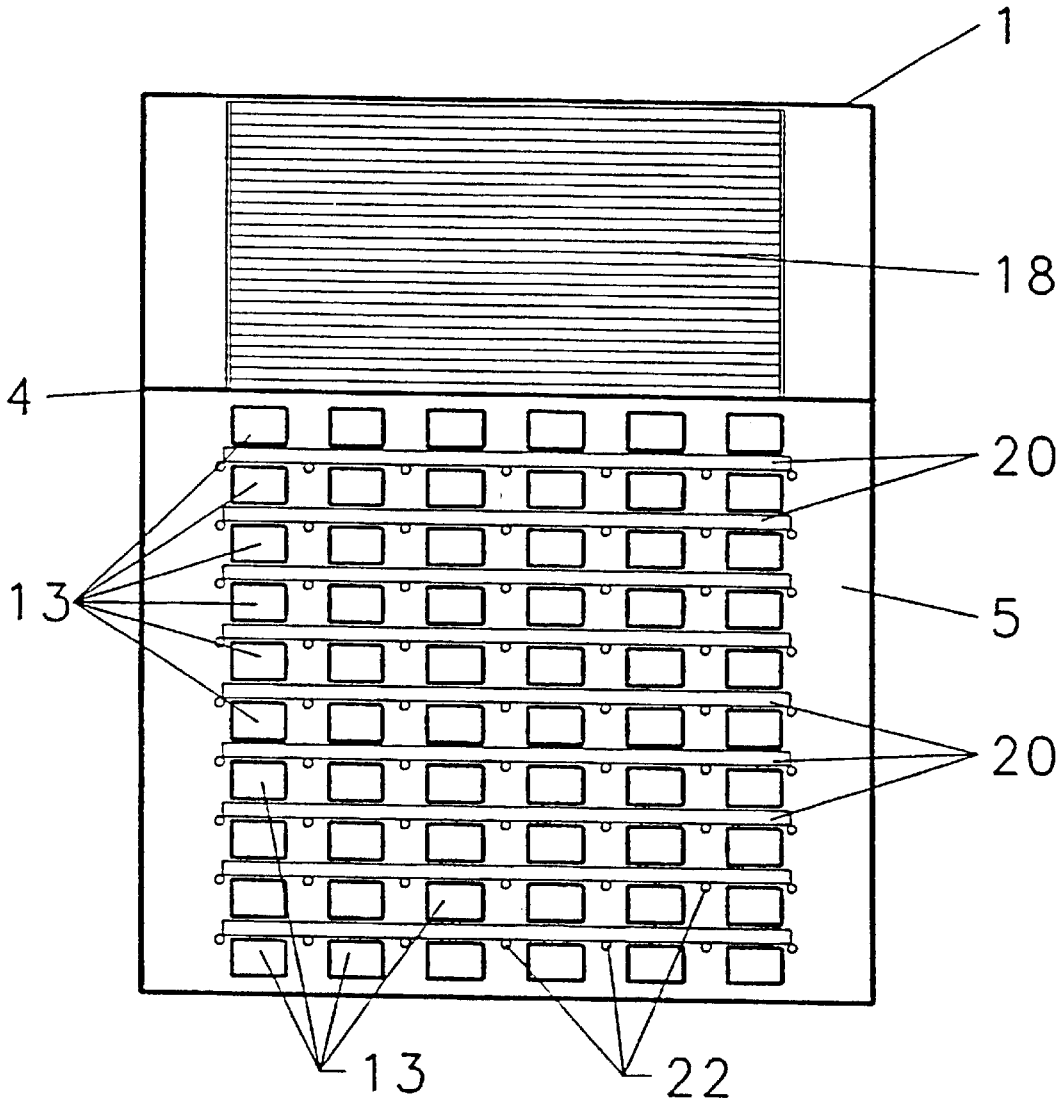
FIG. 2 is a longitudinal section showing the partition wall.

The dryer is formed for example of a plurality of modu larly joined sections. One section measures in the flow direction 2.0 m to 2.5 m and is 2.5 m to 6.0 m wide. As shown in FIGS. 1 and 2, it has a cover 1 and end walls 2 and 3.

In the center an intermediate floor 4, a partition 5, and a mesh-like frame 6 define a center region 7 separate from a peripheral flow passage. This latter is formed by a horizontal passage 8 above the center region 7, an end vertically extending feed chamber 9, and on the opposite side a generally mirror-symmetrical collecting chamber 10. The width of the center region 7 accounts for 50 to 70% of the overall width, its height about 60 to 80% of the overall height. In the center region 7 there are a plurality, in practice at most four to twelve, of levels that are uniformly spaced at about 250 mm to 350 mm one above the other of rollers 22 that are journaled at one side on the partition wall 5 and at the other in a support frame 6. All the rollers 22 are driven at the same speed via unillustrated gears and chains and form at each level a roller conveyor that extends over the entire length of the dryer.

Below and above the conveyor levels, on which the material 11 being dried lying on the roller conveyors is moving continuously through the dryer, there are in the spaces between adjacent rollers 22 finger-like nozzle boxes 12 that extend over the width of the roller conveyors. The walls of the nozzle boxes 12 facing the transport plane are provided with nozzle openings for blowing out drying air onto the material 11 to be dried.

One end of each nozzle box 12 is formed as an intake opening 13, and the other end 14 is closed. The nozzle boxes 12 are shaped like wedges so that their cross-sectional size decreases steadily toward the closed end 14. The end with the intake opening 13 is fitted to a rectangular aperture of the partition wall 5.

The partition wall 5 carries guide bodies 20 between two vertically adjacent nozzle boxes 12. These project into the feed chamber 9. The guide bodies 20 extend over the entire length of the partition wall 5. The vertical dimension H of the guide bodies 20 immediately adjacent the partition 5 corresponds generally to the spacing between the upper edge of the intake opening 13 of one nozzle box 12 and the lower edge of the intake opening 13 of the nozzle box 12 immediately thereabove. Thus each guide body 20 is of neutral cross section relative to the intake openings 13, that is the cross-sectional size of the intake opening 13 is not affected. The length L by which the guide bodies 20 project into the feed chamber 9 is 60 mm to 100 mm, preferably 60 mm to 80 mm.

A blower 15 driven by a motor 16 is mounted in the collecting chamber 10 on the side wall 2. The intake of the blower 15 is open into the collecting chamber 10. The output of the blower 15 is connected with a diffusor 17 that opens into the horizontal passage 8. At the end of the horizontal passage 8 opposite the blower 15 is a heat exchanger 18. The collecting chamber 10 and the horizontal passage 8 are separated by a wall 19.

The invention is also usable with other dryers in which as a result of compact construction disturbing turbulence is created at the intake into the nozzle boxes, e.g. a strip dryer. In them a meander belt can be used instead of a plurality of conveyors. This makes the problem of turbulence with an increasing number of level even more apparent, in particular with gypsum-board dryers where up to twelve levels are used.

In another embodiment of the dryer there is instead of a heat exchanger direct heating of the drying air with a burner.

In another embodiment of the invention a guide body 20 extends over the entire width of the intake opening 13 of a nozzle box 12.

In an embodiment of the dryer for gypsum boards there are preferably between two adjacent transport planes an upper nozzle box 12 and a nozzle box 12 directly underneath connected together in tandem so that both form a double box and have a common inlet opening 13.

In use the fan 15 draws drying air out of the collecting chamber 10 and pushes it through the diffusor 17 into the horizontal passage 8 in the direction of arrow 21. At the end of this passage 8 the drying air flows through the heat exchanger 18 where it is heated and then it flows into the feed chamber 9. The flow is here from above to below and must be diverted into a nearly horizontal flow to enter into the nozzle boxes 12. To this end the guide bodies 20 project into the feed chamber 9 and smooth out the flow lines so that turbulence is avoided. The drying air is blown out of the nozzles onto the upper faces of the material 11 being dried, taking water from it and flowing into the collecting chamber where it is again sucked into the fan 15. A portion of the drying air that corresponds generally to the vaporized water is vented from the circulation path.

Figure 3:
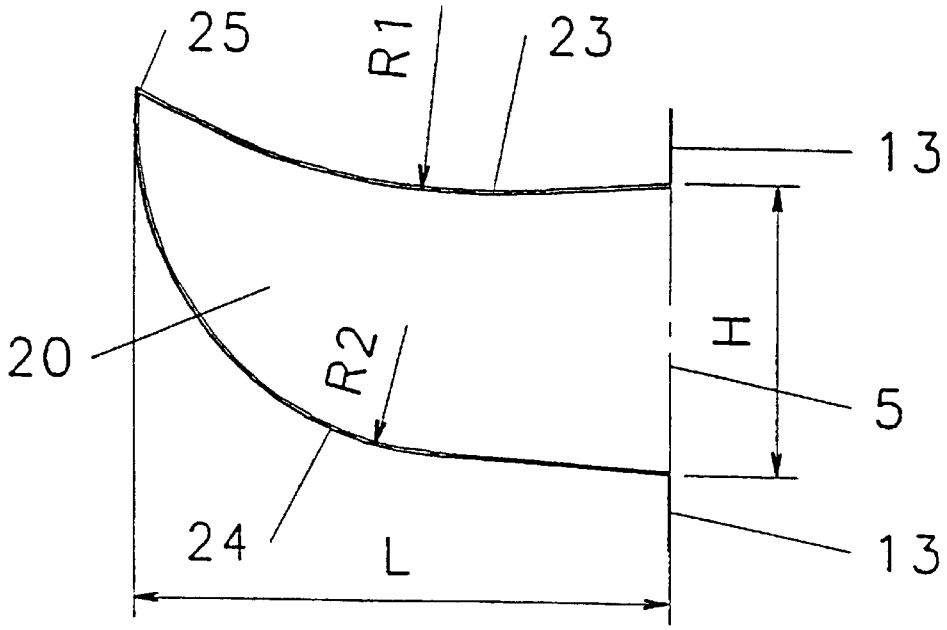
FIG. 3 is a detail view of a guide body.

The guide body 20 shown in section in FIG. 3 is preferably used in dryers for furniture plywood. It is here shaped as a slightly upwardly bent finger. Geometrically the section of the guide body 20 is formed of two circle segments with offset centers. The radius R1 of the upper circle segment 23 is 180 mm to 220 m, preferably 190 mm to 210 mm; the radius R2 of the lower circle segment 24 is 80 mm to 120 mm, preferably 90 mm to 100 mm.

In another embodiment of the guide body 20 there is instead of the pointed end 25 a rounding with a radius from 10 mm to 15 mm.

Figure 4:
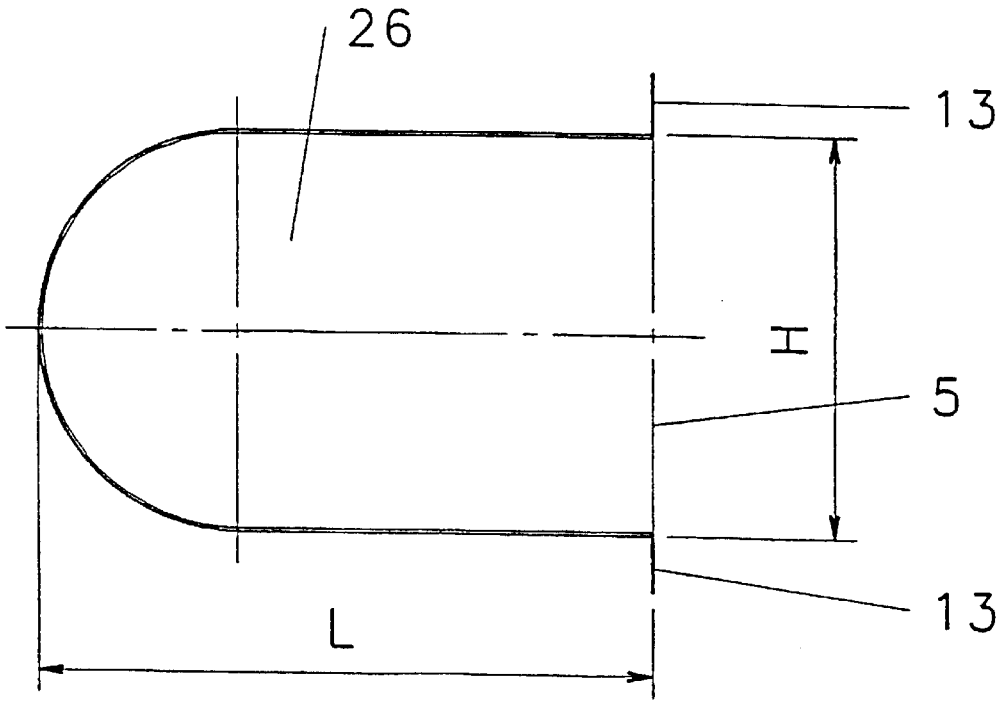
FIG. 4 is a detail view of an alternate embodiment of a guide body.

The guide body shown in section in FIG. 4 is preferably used in dryers for gypsum boards. The guide body 26 here has the shape of a rectangle with a semicircularly rounded end, the rounded end projecting into the feed chamber 9.

What is claimed is:

1. A dryer for flat workpieces, the dryer comprising:

a housing;

an upright partition in the housing defining a treatment space and a vertical feed chamber to one side of the space, the housing having a collecting chamber to an opposite side of the space and a passage extending horizontally between the collecting chamber and feed chamber;

conveyor means in the treatment space for displacing the workpieces longitudinally and horizontally through the housing in a plurality of vertically spaced levels;

respective nozzle boxes extending at the levels above and below the workpieces, having ends open at the partition into the feed chamber, having opposite closed ends, and formed with holes open vertically toward the workpieces;

means including a blower for drawing air out of the collecting space, passing it through the passage to the feed space, and forcing it through the boxes and out of the holes; and respective flow-guide bodies projecting from the partition into the feed chamber between the open nozzle-box ends.

2. The dryer defined in claim 1 wherein the bodies each have a curved side turned toward the passage.

3. The dryer defined in claim 2 wherein the curved sides are concave toward the passage and define a sharp edge directed generally toward the passage.

4. The dryer defined in claim 3 wherein the bodies each have a curved side turned away from the passage.

5. The dryer defined in claim 4 wherein both of the curved sides have centers of curvature lying between the respective body and the passage.

6. The dryer defined in claim 5 wherein the centers of curvature of each body are offset from each other.

7. The dryer defined in claim 2 wherein the curved sides are convex toward the passage.

8. The dryer defined in claim 7 wherein the bodies each have another curved side turned away from the passage and forming a rounded outer end on the respective body.

9. The dryer defined in claim 1 wherein each of the boxes is tapered away from the respective open end toward the respective closed end.

10. The dryer defined in claim 1 further comprising means in the housing downstream of the blower and upstream of the boxes for heating the air moved by the blower.

* * * * *